US005348449A

United States Patent [19]

Wilke et al.

[11] Patent Number: 5,348,449

[45] Date of Patent: Sep. 20, 1994

[54] AIRFLOW REGULATOR

[75] Inventors: Robert A. Wilke, Winona, Minn.; James M. Grupa, Dodge, Wis.

[73] Assignee: Lake Center Industries, Inc., Winona, Minn.

[21] Appl. No.: 978,716

[22] Filed: Nov. 19, 1992

[51] Int. Cl.[5] ..... F04F 5/48

[52] U.S. Cl. ..... 417/54; 137/499; 417/189

[58] Field of Search ..... 137/499, 521, 892, 895; 417/54, 157, 187, 189

[56] References Cited

U.S. PATENT DOCUMENTS

| | | | |
|---|---|---|---|
| 702,005 | 6/1902 | Horenz | 417/157 |
| 947,166 | 1/1910 | Smith | 137/521 |
| 1,437,015 | 11/1922 | Qualman | 417/187 |
| 1,459,961 | 6/1923 | Wheeler | 417/187 X |
| 1,751,820 | 3/1930 | Knudson | 417/157 |
| 3,981,326 | 9/1976 | Gorchev | 417/189 X |
| 4,523,609 | 6/1985 | Weck | 137/499 |

*Primary Examiner*—Robert G. Nilson

*Attorney, Agent, or Firm*—Dorn, McEachran, Jambor & Keating

[57] ABSTRACT

A passive aspirator based on the Venturi effect has a pivotable flap in the inlet portion of a first air passage. The flap reduces the air flow through the passage when high pressure is present. A spring biases the flap toward an open position. Increasing air flow overcomes the spring force and tends to close the flap. This variable-volume flow allows use of a large enough passage to aspirate sufficient air at low flow rates but does not produce excess waste air at high flow rates.

6 Claims, 1 Drawing Sheet

C
10
12
14
16
18
20
22
24
26
28
30
32
34
A
B 68
70
72
64
66
30
46
32

44
40
48
54
52
56
50
38
42
36

58
60
30
62

52
54
50
56

36
44
38
52
48
56
50
54

AIRFLOW REGULATOR

BACKGROUND OF THE INVENTION

This invention relates to an airflow regulator, and more particularly to a passive aspirator. It is especially intended for use in an automotive climate control system and will be described in connection with that application. It will be understood that the invention is not limited to automotive use but could be used in any passive aspirator, regardless of the application.

Automatic climate control systems for automotive vehicle passenger compartments require several inputs of information. Among these is the current temperature of the air in the compartment. The temperature information is used to regulate the vehicle's heating, ventilating and air conditioning system. To obtain an accurate reading of the temperature, it is necessary to cause the movement of a representative sample of vehicle interior air across a temperature sensor. The sensor is typically a thermistor (a negative temperature coefficient resistor) mounted in an air passage or duct. The air movement can be created by an active or passive aspirator. An active aspirator uses a small electrical fan to create the pressure differential which causes air to flow past the thermistor. A passive aspirator uses the Venturi effect to create the pressure difference from a positive pressure source. This pressure difference, in either case, causes the required air flow across the sensor.

A typical passive aspirator of the type known in the prior art is capable of moving 0.2 to 0.5 $ft^3$/min. (cfm) of air past the thermistor. It is a matter of debate whether this is sufficient air flow to provide an accurate temperature reading. Some skilled in the art believe that a higher air flow is desirable to obtain a better temperature sample and, therefore, better regulation of vehicle interior temperature.

One way to achieve higher air flow is, of course, to use an active aspirator with its electric fan but this approach significantly adds to the cost of the system. Another way to achieve higher air flow without the cost of an active aspirator is to use a larger passive aspirator but doing so leads to other problems. Scaling up the size of the aspirator results in increasing the amount of air flowing through the device. This is waste air which is dumped somewhere under the vehicle instrument panel. Waste air generally has not been heated or cooled to the desired temperature, nor is it directed through the user-selected vents or ducts. While some waste air can be tolerated, excessive amounts are considered detrimental to occupant comfort. This limit on waste air, as well as physical constraints within a vehicle, restricts the size of a passive aspirator.

Sizing a passive aspirator is further complicated by the fact that the positive air pressure source is typically the main fan for the vehicle temperature control system. The main fan speed can be selected by the vehicle occupants at anywhere from 0 to 100% of maximum. Thus, the positive pressure applied to the aspirator can vary widely. An aspirator large enough to generate, say, 1 cfm of flow across the thermistor at a fan speed of 20%, will probably produce excess waste air at a fan speed of 80%. Conversely, an aspirator small enough to avoid excessive waste air at a fan speed of 80% of maximum will generate too small a flow at 20% fan speed. The present invention overcomes these difficulties by providing a passive aspirator having a variable flow volume dependent on the level of positive pressure at the aspirator inlet.

SUMMARY OF THE INVENTION

The present invention relates to an airflow regulator and is particularly concerned with a passive aspirator.

A primary object of the invention is a passive aspirator that provides ample aspirated air at a low cost, as opposed to motorized or active aspirators that provide aspirated air at high cost.

Another object of the invention is a passive aspirator having a variable volume inlet passage which provides sufficient aspirated air at low pressure and prevents excessive waste air at high pressure.

Another object of the invention is a passive aspirator of the type described which automatically compensates for the applied positive pressure without the need for costly monitoring or control devices.

A further object of the invention is an aspirator of the type described which is simple to manufacture and reliable in operation.

These and other objects which may become apparent are realized by a passive aspirator having first and second air passages. The first passage has an inlet in communication with a positive air pressure source, such as the main blower fan in an automotive vehicle. The first passage also has an outlet and a throat between the inlet and outlet. The inlet to the second passage is located somewhere in the vehicle's passenger compartment. The second passage joins the first passage at the throat. The throat is sized to produce a Venturi effect and aspirate air from the passenger compartment into the second passage. A thermistor is mounted in the second passage to detect the air temperature.

An airflow regulator for the aspirator includes a flap mounted in the inlet portion of the first passage. The flap pivots on a shaft between open and closed positions to regulate the air flow into the throat. A spring engages the flap or its pivot shaft and biases it toward the open position. Higher main fan speed increases the air flow into the first passage, causing the flap to move against the bias of the spring toward the closed position. This flap movement effectively reduces the first passage volume, adjusting the amount of air flowing into the throat and out of the outlet.

DETAILED DESCRIPTION OF THE INVENTION

Figures 1, 2, 3, 4, 5, 6:
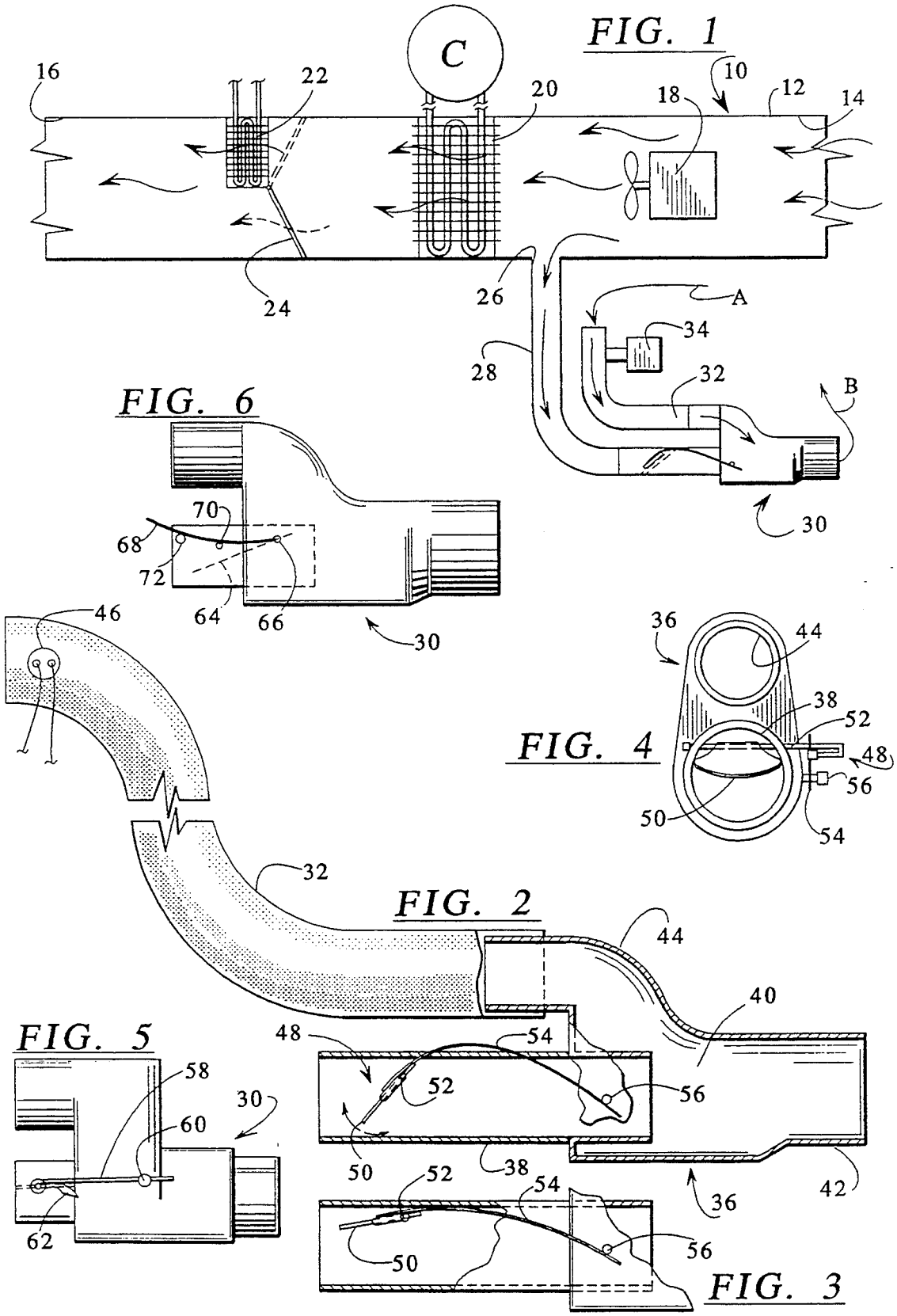
FIG. 1 is a schematic illustration of a simplified vehicle heater and air conditioning unit.
FIG. 2 is an enlarged elevation view of a passive aspirator according to the present invention, with parts in section, showing the flap in a closed position.
FIG. 3 is an elevation view, partially in section, of the inlet portion of the first passage, showing the flap in an open position.
FIG. 4 is an end elevation view of the aspirator, looking into the inlet portions of the passages.
FIG. 5 is an elevation of an alternate form of spring for the flap.
FIG. 6 is a view similar to FIG. 5, showing a further alternate version of the flap spring.

FIG. 1 shows a simplified diagram of a vehicle heater and air conditioning unit assembly 10. The assembly includes a main air duct 12 having an inlet end 14 and an outlet end 16. It will be understood that the outlet end is connected to various air ducts (not shown) directed to the vehicle floor, dash and defrost vents. The assembly 10 further includes a main fan or blower 18, a compressor C connected to an air conditioning evaporator 20 and a heater core 22. The blower 18 forces air through the evaporator 20 and then, depending on the position of a blend door 24, through or around the heater core 22.

A small portion of the air from blower 18 is routed through port 26 to a duct 28. Duct 28 connects to the passive aspirator shown generally at 30. A second duct 32 also connects to the aspirator and extends to an opening located somewhere in the passenger compartment where a representative sample of air is to be drawn. A temperature sensor of some sort, indicated generally at 34, is disposed in duct 32. The aspirator draws air from the passenger compartment into duct 32, as indicated by arrow A. Waste air exhausts from the aspirator as shown by arrow B.

FIG. 2 illustrates details of the aspirator 30. The aspirator body includes a first passage 36 having an inlet 38, a throat 40 and an outlet 42. A second passage 44 is in fluid communication with the duct 32 and joins the first passage in the area of the throat 40. The throat is sized to produce a Venturi effect pressure drop which causes vehicle air to enter duct 32. This air passes the temperature sensor, such as thermistor 46, enters passage 44, goes into throat 40 and out the outlet 42.

An airflow regulator 48 is built into the aspirator 36. The regulator includes a flap 50 pivotably mounted on a pivot shaft 52 in the inlet portion of the first passage. The flap 50 is moveable between a closed position shown in FIG. 2 and an open position as shown in FIG. 3. It will be understood that the terms open and closed are used relatively, i.e., the flap 50 does not completely close or open the inlet portion of the first passage. The pivot shaft 52 extends to the exterior of the inlet 38 where a spring 54 is fixed to the shaft. The spring 54 may take the form of a linear beam, and may for example be a length of music wire. The end of the spring remote from the shaft bears against a support post 56 which is attached to the body of the aspirator. The spring biases the flap to its open position.

The use and operation of the invention are as follows. The amount of air drawn into duct 32 depends on the pressure drop in the throat which in turn depends on a number of factors, one of the more significant of which is the speed of the main blower 18. At low blower speeds air is forced into duct 28 and inlet 38 but not in sufficient amount or speed to move the flap 50. Almost the full volume of the first passage is available for air flow into the throat. This permits sufficient flow to create enough of a pressure drop to aspirate an acceptable volume through the second passage so a reliable temperature reading can be obtained. At the low blower speed, waste air volumes through the outlet 42 are also acceptable.

At higher blower speeds more air is forced into the inlet 38 through duct 28. The higher volume and speed of the air entering inlet 38 overcomes the spring force on the flap, causing the flap to move toward a closed position and also causing the spring 54 to bow upwardly, as seen in FIG. 2. The partially closed flap decreases the volume of air entering the throat from what it would otherwise be. Sufficient air is aspirated but waste air is kept to an acceptable level. When the blower speed is reduced, the spring 54 pivots the flap back toward its open position.

One of the advantages of the present invention is the flap movement is automatic and does not require complicated sensors or controls. The spring 54 is designed to apply the correct spring rate to put the flap in the proper position for the current blower speed. It has been found that a non-linear spring rate achieves the best results.

Alternate forms of the spring are shown in FIGS. 5 and 6. In FIG. 5, the spring 58 is fixed to a support post 60, instead of to the flap's pivot shaft. The free end of the spring (at the left side of FIG. 5) bears against a cam 62 which is fixed to and rotates with the flap pivot shaft. With this arrangement the shape of the cam lobe controls the restoring force applied by the spring 58 to the flap. The cam shape can be designed to apply a non-linear spring force to the flap.

In the FIG. 6 embodiment the flap is shown schematically at 64 mounted on a pivot shaft 66. Closure of the flap 64 is resisted by the spring 68. Spring 68 is also fixed to the pivot shaft and as the flap 64 closes, spring 68 bears first against support post 72, giving one spring rate, and then against support post 70, giving a second, higher spring rate.

Whereas a preferred form of the invention has been shown and described, it will be realized that alteration and modifications could be made thereto without departing from the scope of the following claims. For example, the spring could take forms other than the linear beam spring shown. A wound, clock-type spring is an alternative that could be used.

I claim:

1. In an aspirator of the type having first and second air passages, the first passage defining an air flow axis and having an inlet in communication with a positive air pressure source, an outlet and a throat between the inlet and outlet, the second passage joining the first at the throat, the throat being sized to produce a Venturi effect and aspirate air into the second passage, the improvement comprising an airflow regulator having a flap mounted in the inlet portion of the first passage and pivotable between open and closed positions to regulate the air flow into the throat; the flap being disposed at an angle to the air flow axis of the first passage such that air flow through the first passage biases the flap toward the closed position, and a biasing means engageable with the flap and biasing it toward and open position.

2. The aspirator of claim 1 wherein the flap is mounted on a pivot shaft.

3. The aspirator of claim 2 further comprising a support post fixed to one of the first or second passages, and wherein the biasing means comprises a linear beam spring fixed to the pivot shaft and bearing against the support post.

4. The aspirator of claim 3 further comprising a second support post fixed to one of the first or second passages, in a position where the spring bears against the second post only after engaging the other support post.

5. The aspirator of claim 2 further comprising a support post fixed to one of the first or second passages, and a cam fixed to the pivot shaft and wherein the biasing means comprises a linear beam spring fixed to the support post and bearing against the cam.

6. A method of regulating air flow through a passive aspirator of the type having first and second air passages, the first passage having an inlet in communication with a positive air pressure source, an outlet and a throat between the inlet and outlet, the second passage joining the first at the throat, the throat being sized to produce a Venturi effect and aspirate air into the second passage, the method comprising the steps of:

pivotably mounting a flap in the inlet portion of the first passage for rotation between open and closed positions;

biasing the flap with a biasing means toward the open position while permitting it to move toward the closed position in the presence of increased positive air pressure in the inlet portion, thereby restricting the air flow through the aspirator when the pressure increases; and increasing the biasing force non-linearly as the positive air pressure increases.

* * * * *